US007152852B1

(12) United States Patent
Habu et al.

(10) Patent No.: US 7,152,852 B1
(45) Date of Patent: Dec. 26, 2006

(54) PRIMING SYSTEM FOR A FLOAT BOWL CARBURETOR

(75) Inventors: Katsushi Habu, Sendai (JP); Azuma Ohji, Miyagi-Pref. (JP); Hidenobu Takahashi, Natori (JP); Toshimasa Takahashi, Shiroishi (JP); Takeshi Kobayashi, Yokohama (JP)

(73) Assignee: Walbro Japan, Inc., Tokyo (JP)

( * ) Notice: Subject to any disclaimer, the term of this patent is extended or adjusted under 35 U.S.C. 154(b) by 153 days.

(21) Appl. No.: 10/780,690

(22) Filed: Feb. 17, 2004

(51) Int. Cl.
*F02M 1/16* (2006.01)

(52) U.S. Cl. ..... 261/70; 123/179.11; 261/72.1; 261/DIG. 8

(58) Field of Classification Search ..... 261/70, 261/72.1, DIG. 8; 123/179.11
See application file for complete search history.

(56) References Cited

U.S. PATENT DOCUMENTS

| | | | | |
|---|---|---|---|---|
| 3,281,129 A | | 10/1966 | Payne | 261/34.1 |
| 3,430,933 A | | 3/1969 | Taggart | 261/34.2 |
| 4,679,534 A | * | 7/1987 | Guntly et al. | 123/179.11 |
| 4,738,232 A | | 4/1988 | Scott | 123/179.11 |
| 4,793,951 A | | 12/1988 | Scott | 261/35 |
| 5,740,781 A | | 4/1998 | Scott et al. | 123/437 |
| 5,803,035 A | * | 9/1998 | Guntly | 123/179.11 |
| 6,152,431 A | * | 11/2000 | Stenz et al. | 261/34.1 |
| 6,557,833 B1 | | 5/2003 | Roth | 261/34.1 |
| 6,672,570 B1 | * | 1/2004 | Takano et al. | 261/39.2 |

FOREIGN PATENT DOCUMENTS

| | | | | |
|---|---|---|---|---|
| JP | 59-194067 | | 11/1984 | |
| JP | 1-117975 | * | 5/1989 | 261/DIG. 8 |

* cited by examiner

*Primary Examiner*—Richard L. Chiesa
(74) *Attorney, Agent, or Firm*—Reising, Ethington, Barnes, Kisselle, P.C

(57) ABSTRACT

A float bowl type carburetor has a fuel and air mixing passage extending therethrough, a float bowl assembly, a priming pump communicated with the float bowl assembly and a fuel supply pipe that is communicates fuel in the float bowl assembly with the fuel and air mixing passage. The priming pump is operable to deliver pressurized fluid into the float bowl assembly in the area of the fuel supply pipe. Preferably, the priming pump discharges fluid in line with the fuel supply pipe so that at least some of the fluid discharged from the priming pump flows directly into the fuel supply pipe to facilitate delivering a rich fuel and air mixture to the engine to facilitate starting the engine.

20 Claims, 3 Drawing Sheets

PRIMING SYSTEM FOR A FLOAT BOWL CARBURETOR

FIELD OF THE INVENTION

The present invention relates generally to a carburetor and more particularly to a float bowl type carburetor.

BACKGROUND OF THE INVENTION

Some carburetors include a priming pump with a flexible bulb that can be depressed to force fluid from the bulb into the carburetor to prime the carburetor. In one carburetor, fluid discharged from a priming pump flows through a passage that directs the fluid away from a fluid supply pipe of the carburetor through which fuel is supplied to a fuel and air mixing passage for subsequent delivery to an engine in a fuel and air mixture. The flow of fluid away from the fuel supply pipe does not effectively remove air from the fuel supply pipe or direct fuel into and through the fuel supply pipe such as to provide a richer than normal fuel and air mixture to the engine to facilitate starting it.

In another carburetor construction, when the priming pump bulb is actuated or depressed, air is discharged under pressure from the priming pump to an atmospheric air space above the fuel level of a float chamber. Prior to depressing the bulb, an atmospheric vent is closed so that a super atmospheric pressure is developed in the air space when the air is discharged therein by the priming pump. The super atmospheric pressure in the air space acts on the fuel in the fuel chamber and causes fuel in the float chamber to flow into the fuel supply pipe to prime the carburetor. A large-capacity priming pump is required to sufficiently pressurize the atmospheric air space above the fuel level of the float chamber. Further, the operation of the priming pump in this carburetor is not easily controlled resulting in overly lean or overly rich fuel and air mixtures delivered to an engine upon starting the engine. The undesirable fuel and air mixtures result in failure to start the engine, or in a start and idle of the engine that is not stable or cannot be maintained.

In one construction of a carburetor of this type, the atmospheric vent for the air space of the float chamber is provided in the priming pump bulb. While the vent may be conveniently closed by a finger of an operator when the priming pump is actuated, the open vent permits contaminants such as dust, dirt and water to enter the vent when it is not closed.

SUMMARY OF THE INVENTION

A float bowl type carburetor has a fuel and air mixing passage extending therethrough, a float bowl assembly, a priming pump communicated with the float bowl assembly and a fuel supply pipe that is communicates fuel in the float bowl assembly with the fuel and air mixing passage. The priming pump is operable to deliver pressurized fluid into the float bowl assembly in the area of the fuel supply pipe. Preferably, the priming pump discharges fluid in line with the fuel supply pipe so that at least some of the fluid discharged from the priming pump flows directly into the fuel supply pipe to facilitate delivering a rich fuel and air mixture to the engine to facilitate starting the engine.

In one presently preferred embodiment, at least some of the fuel discharged by the priming pump flows into and through the fuel supply pipe and into the fuel and air mixing passage. The priming pump and carburetor are preferably constructed and arranged so that relatively few actuations, and possibly a single actuation, of the priming pump provides fuel in the fuel supply pipe, and more preferably in the fuel and air mixing passage as set forth above.

Some objects, features, advantages and aspects that may be achieved by certain embodiments of this invention include providing a carburetor that delivers a rich fuel and air mixture to facilitate starting an engine, accurately delivers a desired fuel and air mixture to an engine, can repeatedly deliver a rich fuel and air mixture to an engine, includes a priming pump that requires few actuations in operation, is small, can be mounted in different locations relative to the carburetor, effectively pressurizes fuel in a float bowl to facilitate delivery of fuel into a fuel and air mixing passage of the carburetor, improves the starting and initial running performance of an engine, is rugged, durable, and is of relatively simple design and economical manufacture and assembly.

BRIEF DESCRIPTION OF THE DRAWINGS

These and other objects, features and advantages of this invention will be apparent from the following detailed description of the preferred embodiments and best mode, appended claims and accompanying drawings, in which:

DETAILED DESCRIPTION OF THE PREFERRED EMBODIMENTS

Figure 1:
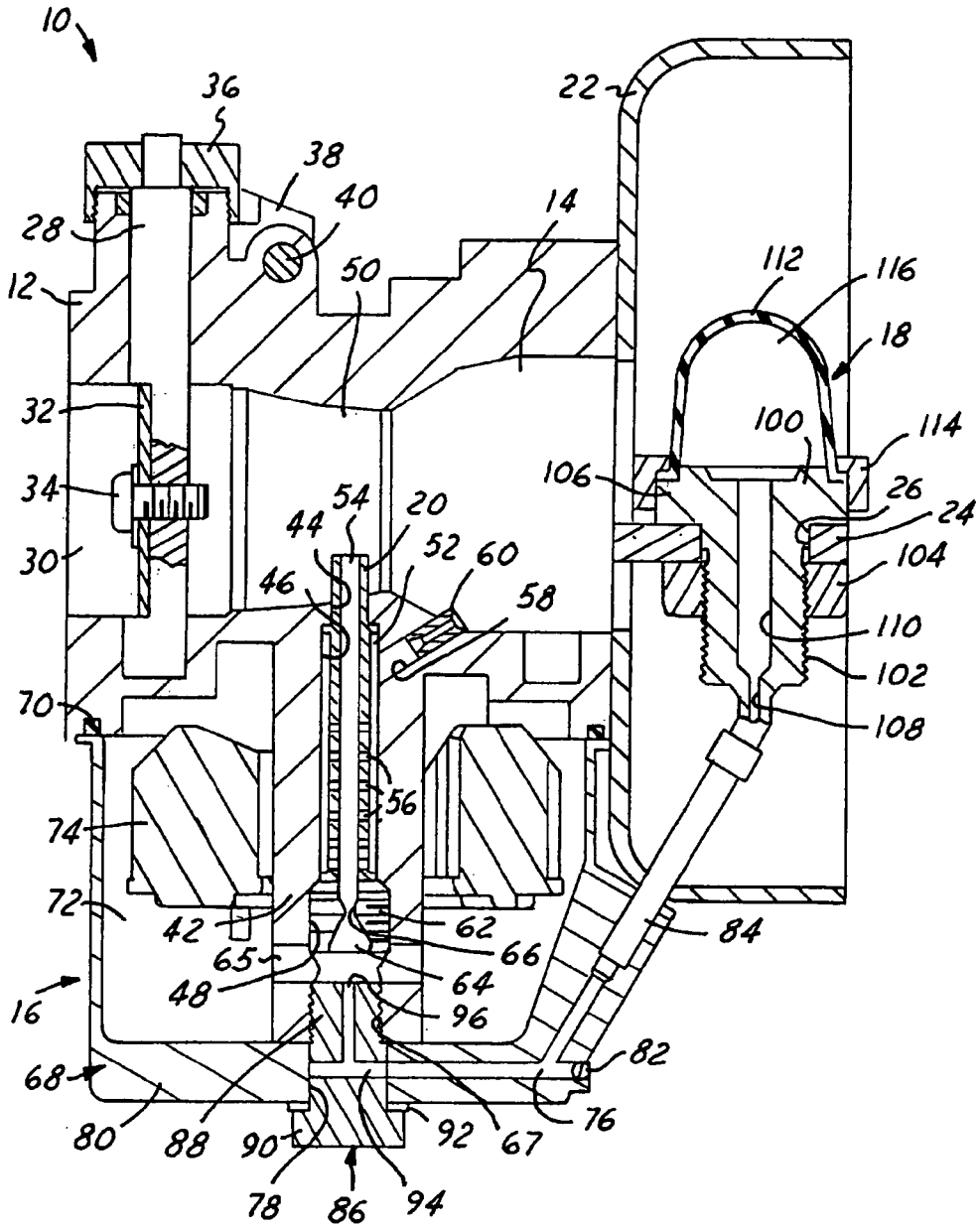
FIG. 1 is a side sectional view of a float bowl type carburetor according to a first embodiment of the present invention.

Referring in more detail to the drawings, FIG. 1 illustrates a float bowl type carburetor 10 having a main body 12 with a fuel and air mixing passage 14 extending therethrough, a float bowl assembly 16 carried by the main body 12 and a priming pump 18 communicated with the float bowl assembly 16. Fuel from the float bowl assembly 16 is delivered to the fuel and air mixing passage 14 through a fuel supply pipe 20 that is preferably carried by the main body 12. The priming pump 18 is operable to deliver pressurized fluid into the float bowl assembly 16 in the area of the fuel supply pipe 20. Preferably, the priming pump 18 discharges fluid in line with an inlet of the fuel supply pipe 20 so that at least some of the fluid discharged from the priming pump 18 flows directly into the fuel supply pipe 20. In one presently preferred embodiment, fuel discharged by the priming pump 18 flows into and through the fuel supply pipe 20 with at least some of the fuel entering the fuel and air mixing passage 14. The priming pump 18 and carburetor 10 can preferably be constructed and arranged so that relatively few and even a single actuation of the priming pump 18 provides fuel in the fuel supply pipe 20, and more preferably in the fuel and air mixing passage 14 as set forth above.

The carburetor 10 may also include a casing 22 in which a filter of an air cleaner (not shown) may be received to filter air before it enters the fuel and air mixing passage 14. A mounting plate 24 with a through bore 26 is coupled to the outer wall of the casing 22. A throttle valve shaft 28 is rotatably supported in the vicinity of an outlet end 30 of the fuel and air mixing passage 14, and a throttle valve 32 is secured to the valve shaft 28 such as by a bolt 34. A throttle valve lever 36 is secured to the upper end of the throttle valve shaft 28, and a projection 38 of the throttle valve lever 36 is engageable with an idle stop bolt 40 threadedly supported on the carburetor main body 12 to set the idle position of the throttle valve 32 at which time the throttle valve 32 substantially closes the fuel and air mixing passage 14.

The carburetor main body 12 preferably also includes a depending cylindrical column 42 with a through bore 44 in which the fuel supply pipe 20 is closely received, a first counterbore 46 and a second counterbore 48. The fuel supply pipe 20 preferably extends out of the bore 44 and into a venturi section 50 of the fuel and air mixing passage 14. The first counterbore 46 defines an annular gap 52 surrounding the fuel supply pipe 20 that is communicated with a central passage 54 of the fuel supply pipe 20 through a plurality of holes 56 in the fuel supply pipe 20. A passage 58 communicates the fuel and air mixing passage 14 with the gap 52 at a location upstream (relative to the direction of airflow through the fuel and air mixing passage 14) of the bore 44, and preferably upstream of the venturi section 50 of the fuel and air mixing passage 14. An air jet 60 is preferably disposed in the passage 58 to control the fluid flow rate therethrough. The fuel supply pipe 20 preferably includes a restriction that may be formed integrally with the fuel supply pipe or in an insert associated with the fuel supply pipe. In one presently preferred embodiment, a main jet 62 is received in the second counterbore 48 and includes a through passage 64 with an orifice or restriction 66 of a desired size. A transverse bore or hole 65, and more preferably a plurality of holes 65 are provided in the column 42 communicating with the passage 64 through the main jet 62. The column 42 preferably also includes an internally threaded section 67 at an end of the second counterbore 48.

A fuel bowl 68 is coupled to the main body 12 surrounding the column 42 with a seal member 70 between the fuel bowl 68 and main body 12 to provide a fluid tight seal between them. When mounted on the main body 12, the fuel bowl 68 preferably engages a lower end of the column 42. The fuel bowl 68 defines a fuel chamber 72 in which a horseshoe-shaped float 74 is received. The float 74 is buoyant and hence, responsive to the level of liquid fuel in the fuel chamber 72 so that when the fuel level in the fuel chamber 72 lowers, an inlet valve (not shown) is opened so that fuel in a fuel tank (not shown) is provided into the fuel chamber 72 via a fuel pump (also not shown). The fuel bowl 68 includes a passage 76 formed therein and extending to a bore 78 formed through a lower wall 80 of the fuel bowl 68. The passage 76 may be cross-drilled with an opening sealed by a plug 82. A conduit, which may be a rigid tube 84, is preferably at least partially received in the passage 76.

A bolt 86 has a threaded shank 88 received through the bore 78 and threadedly received in the threaded section 67 of the column 42. The bolt has an enlarged head 90 that overlies a portion of the fuel bowl 68 surrounding the bore 78, preferably with a seal 92 between them to prevent fuel from leaking out of the fuel bowl 68. The bolt further includes a passage 94 that may be defined by cross-drilled bores to communicate the passage 76 with the second counterbore 48 in the column 42 in the area of the holes 65 and main jet 62. At least a portion of the passage 94 is preferably coaxially aligned with the passage 64 in the main jet 62, and with the fuel supply pipe 20. Preferably, an outlet 96 of the passage 94 is coaxially aligned with and disposed generally adjacent to the main jet 62 so that fluid discharged from the outlet 96 is directed toward or into the main jet 62. Threading the shank 88 of the bolt 86 into the threaded section 67 of the column 42 facilitates coaxially aligning the outlet 96 with the passage 64 of the main jet 62. In one presently preferred embodiment, the outlet 96 is disposed axially spaced from the main jet 62 so that it does not block the holes 65 in the column 42.

The priming pump 18 has a body 100 with a threaded shank 102 received through the bore 26 of the mounting plate 24 and in a nut 104 clamping the mounting plate 24 between a radially outwardly extending flange 106 of the body 100 and the nut 104. The body 100 includes a through bore 108 and a counterbore 110 defining a fluid passage through the body 100. A flexible, resilient and generally dome-shaped bulb 112 is carried by the body 100 with a peripheral edge of the bulb 112 trapped between the flange 106 and an annular retainer 114 that may be threadedly received on the flange 106. A fluid chamber 116 is defined between the bulb 112 and the body 100. The conduit 84 is coupled to the lower end of the body 100 providing fluid communication between the chamber 116 and the passage 76 in the fuel bowl 68.

When it is desired to initially start an engine associated with the carburetor 10, fuel will be present in the fuel chamber 72 to a desired level and in the passage 76 and conduit 84 generally up to the level of fuel in the fuel chamber 72. Fuel will typically not be present in the priming pump chamber 116. To prime the carburetor and provide a richer than normal fuel and air mixture to the engine to facilitate starting the engine, the priming pump 18 is initially actuated by depressing the bulb 112. This reduces the volume of the chamber 116 and discharges the fluid in the chamber 116 (at this stage, typically air and fuel vapor) from the chamber 116 and toward the fuel chamber 72 through the aligned passages and bores. Some liquid fuel may be discharged from the outlet 96 and into the fuel chamber 72 in the direction of the main jet 62, but this is not necessarily so after the first actuation of the priming pump 18. Upon releasing the bulb 112, it will return to its undepressed state thereby increasing the volume of the chamber 116 and drawing fuel from the fuel chamber 72 toward and preferably into the priming pump 18. In some applications the chamber 116 may be filled with liquid fuel at this point, although in some applications it may not be.

When the bulb 112 is depressed again, more liquid fuel, preferably in a relatively high velocity stream of fuel, is discharged from the outlet 94 and towards and into the main jet 62 and fuel supply pipe 20. Fuel also preferably flows out of the fuel supply pipe 20 and into the fuel and air mixing passage 14 to provide the rich fuel and air mixture to the engine upon starting. When the bulb 112 is released, it expands to its undepressed state and liquid fuel is drawn into the passages and bores between the fuel chamber 72 and the priming pump 18 as previously set forth. In this manner, air may be expelled from the fuel circuit to prime the carburetor 10, and preferably at least some fuel is provided into the fuel and air mixing passage 14 prior to starting the engine so that fuel is readily available to the engine upon starting.

The carburetor 10 can be calibrated so that a certain number of depressions or strokes of the bulb 112 provides a desired priming and flow of fuel in the carburetor. The volume of the bulb chamber 116 and passages interconnecting the fuel chamber 72 to the bulb chamber 116 are one factor that affects the fluid flow. Another factor is the flow rate permitted through the main jet 62 compared to the total surface area or combined flow area of all of the holes 56 formed in the fuel supply pipe 20. The flow rate permitted through the main jet 62 is a function of at least the minimum flow area of the main jet 62 which affects the rate at which fuel flows into the fuel supply pipe when it is discharged from the outlet 96 through actuation of the priming pump 18. The flow area of the holes 56 controls the rate at which fuel exits the fuel supply pipe 20 through these holes 56.

Accordingly, with a relatively small flow area in the main jet 62 and relatively large flow area of the holes 56, a relatively large amount of the fuel that flows through the main jet 62 will exit the supply tube 20 through the holes 56 and will not be discharged into the fuel and air mixing passage 14. Therefore, more actuations of the priming pump 18 may be necessary to provide a desired amount of liquid fuel in the fuel and air mixing passage 14. Conversely, the combination of a main jet 62 having a large flow area permitting a higher rate of fuel flow therethrough with holes 56 having a smaller combined flow area will result in comparatively less fuel exiting the fuel supply pipe 20 through the holes 56 and more fuel being discharged into the fuel and air mixing passage 14. In this arrangement, fewer actuations of the priming pump 18 may be necessary to prime the carburetor and provide a desired amount of liquid fuel in the fuel and air mixing passage 14.

In this general manner, the number of actuations of the priming pump 18 that are required, and the amount of fuel provided into the fuel and air mixing passage 14 by operation of the priming pump 18, can be varied or calibrated for a particular application. The number of actuations can vary from one to many as desired for a particular application or range of applications.

In addition or as an alternative, the flow area of the outlet 96 of the passage 94 can be chosen to be smaller than the minimum flow area of the main jet 62 so that the maximum restriction to fuel flow to the fuel supply pipe 20 from the priming system is the outlet 96. Accordingly, the size of the outlet 96 can be chosen along with the flow area of the holes 65 to calibrate the priming system. Further, in one presently preferred embodiment the passage 64 of the main jet 62 is tapered from an inlet to an orifice or restriction 66, so the outlet 96 of the passage 94 can be somewhat misaligned or not coaxial with the passage 64 of the main jet without significant affect on the operation of the priming system and carburetor. And in the construction and arrangement wherein the outlet 96 is smaller than the minimum flow area of the main jet 62, the influence caused by any deviation in concentricity between the outlet 96 and the main jet 62 is lessened and is preferably negligible. It is possible to form the carburetor so that the minimum flow area associated with the fuel supply pipe, which for example, may be defined by the main jet 62 or the outlet 96, is smaller than, greater than or equal to the combined flow area of the holes 56 in the fuel supply pipe 20 as desired for a particular application.

Figure 2:
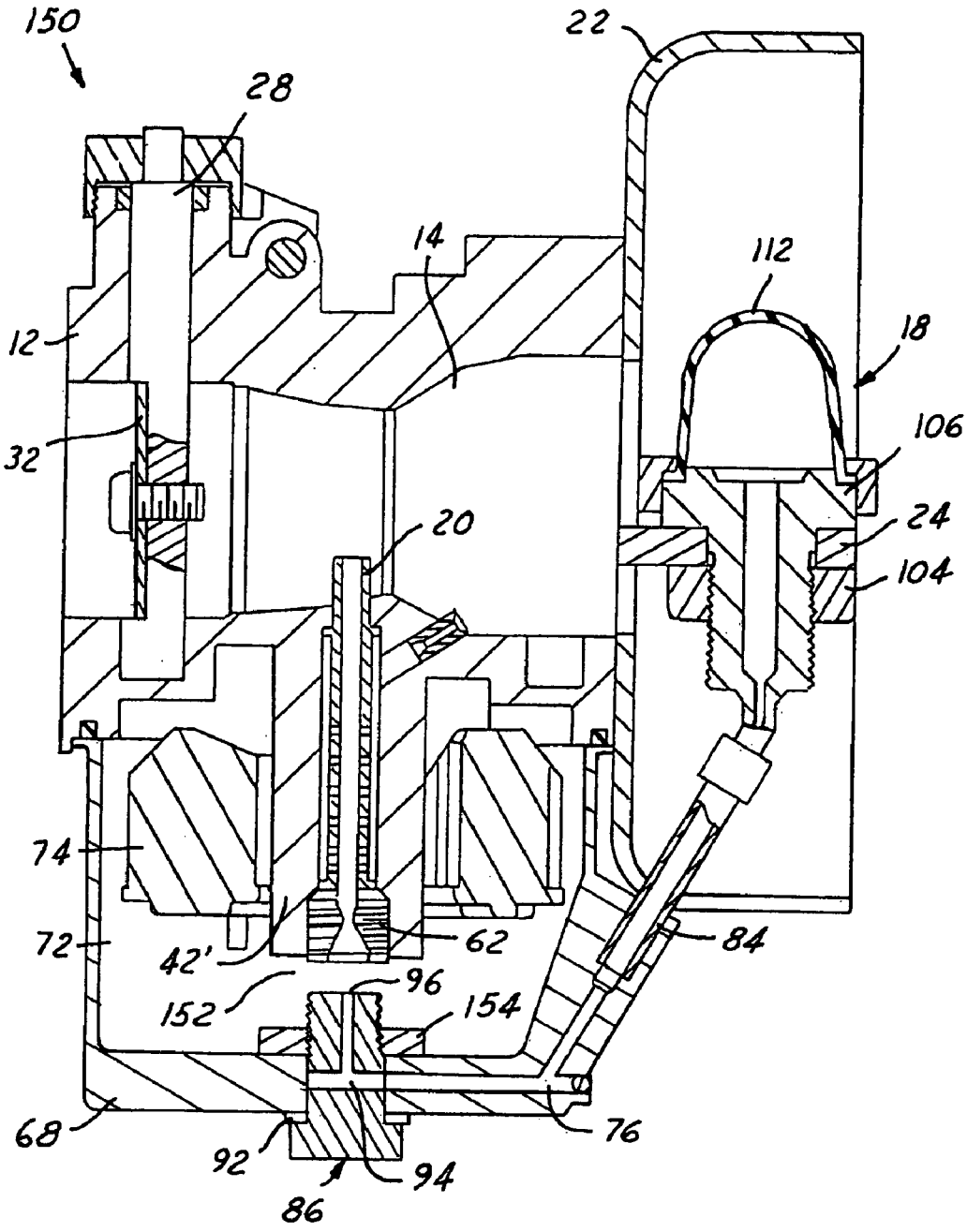
FIG. 2 is a side sectional view of a float bowl type carburetor according to a second embodiment of the present invention.

In a second embodiment of a carburetor 150 as shown in FIG. 2, the column 42' does not extend axially to the fuel bowl 68. A gap 152 is provided between the fuel bowl 68 and the end of the column 42' so that the main jet 62 is in communication with the fuel chamber 72. So the holes 65 that were formed in the column 42 of the prior carburetor 10 are not needed in this carburetor 150. The bolt 86 is retained on the fuel bowl 68 by a nut 154 disposed in the fuel bowl 68. As in the first embodiment carburetor 10, the end of the bolt 86 including the outlet 96 of the passage 94 is preferably axially spaced from and aligned with the main jet 62. The remainder of carburetor 150, including the operation of the carburetor 150 and priming pump 18, may be the same as the first embodiment carburetor 10 and hence, carburetor 150 will not be described further.

Figure 3:
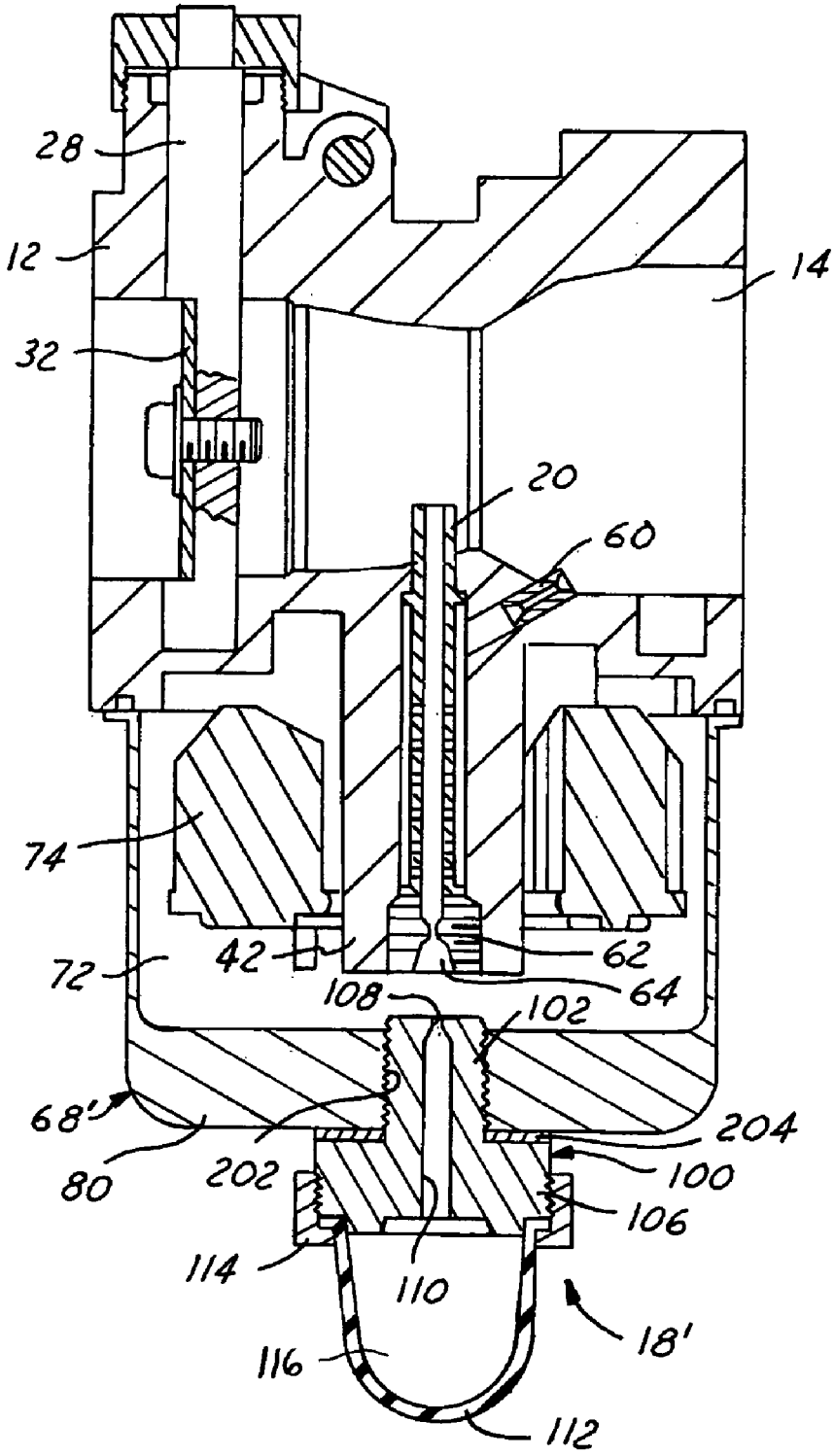
FIG. 3. is a side sectional view of a float bowl type carburetor according to a third embodiment of the present invention.

In a third embodiment of a carburetor 200, as shown in FIG. 3, the priming pump 18' is connected directly to a fuel bowl 68' so that the passage 76, conduit 84, and bolt 86 and associated passage 94 are not needed. The shank 102 of the priming pump body 100 is threadedly received in a threaded hole 202 in the fuel bowl 68'. To prevent fuel from leaking from the fuel bowl 68', a seal 204 is trapped between the flange 106 and the lower wall 80 of the fuel bowl 68'. Like the passage 94 and outlet 96 of the bolt 86 in the prior embodiments of carburetors 10 and 150, the bore 108 and counterbore 110 are preferably axially aligned with the main jet 62 and its passage 64.

In the first two embodiments of carburetors 10, 150, the chamber 116 of the priming pump 18 was disposed higher than the level of fuel in the fuel chamber 72. In this carburetor 200, the chamber 116 is disposed below the level of fuel in the fuel chamber 72 and liquid fuel may completely fill the bulb chamber 116 under the force of gravity prior to the intial actuation of the priming pump 18'. Accordingly, priming of the carburetor 200 and delivery of fuel into the fuel and air mixing passage 14 can potentially be achieved with fewer actuations, or even a single actuation of the priming pump 18'. Otherwise, the carburetor 200 is preferably the same in construction and operation as the carburetor 10 previously described.

While certain preferred embodiments and constructions and arrangements of particular components and aspects of the carburetor and priming pump system have been shown and described herein, one of ordinary skill in this art will readily understand that modifications and substitutions can be made without departing from the spirit and scope of the invention as defined by the appended claims. For example, without limitation, while the presently preferred embodiments of carburetors 10, 150, 200 are shown and described without a choke valve, the present invention can be employed with a carburetor incorporating a choke valve at least substantially without other modification of the carburetors 10, 150, 200. Further, relative adjectives like "upper," "lower," "central," and the like are used to describe features of the apparatus and method with respect to the position and orientation of such features as shown in the accompanying drawings of the presently preferred embodiments.

We claim:

1. A float bowl carburetor, comprising:

a body with a fuel and air mixing passage formed therethrough, and a fuel bowl defining at least a portion of a fuel chamber in which a supply of fuel is maintained;

a fuel supply pipe carried by the body in communication with the fuel and air mixing passage and through which fuel is supplied from the fuel chamber to the fuel and air mixing passage;

a fuel passage defined at least in part by a passage defined by the body and having an outlet generally coaxially aligned with the fuel supply pipe; and a priming system including a priming pump communicated with the fuel supply pipe and the fuel chamber through said fuel passage and operable to discharge fluid through said outlet and into said fuel supply pipe upon actuation of the priming pump, wherein said passage defined by the body that defines part of the fuel passage is in fluid communication with the priming pump and is adapted to receive liquid fuel therein.

2. The float bowl carburetor of claim 1 wherein said fuel supply pipe includes a main jet with a passage that defines the minimum flow area through the fuel supply pipe and wherein the outlet is disposed upstream of the passage of the main jet and the flow area of the outlet is larger than the minimum flow area through the fuel supply pipe.

3. The float bowl carburetor of claim 2 wherein the passage of the main jet is coaxially aligned with the fuel supply pipe.

4. The float bowl carburetor of claim 1 wherein said outlet is smaller than the minimum flow area through the fuel supply pipe.

5. The float bowl carburetor of claim 1 that also includes a bolt carried by the fuel bowl and having a passage formed therein with said passage defining a portion of the fuel passage.

6. The float bowl carburetor of claim 5 wherein the passage in the bolt communicates at one end with the portion of the fuel passage formed in the body and the other end of the passage defines the outlet of the fuel passage.

7. The float bowl carburetor of claim 6 wherein the passage in the bolt is defined by cross-drilled bores.

8. The float bowl carburetor of claim 1 wherein said fuel supply pipe includes at least one hole between its ends through which fuel may exit the fuel supply pipe.

9. The float bowl carburetor of claim 8 wherein the minimum flow area of the fuel supply pipe is greater than the combined flow area of all of said at least one hole in the fuel supply pipe.

10. The float bowl carburetor of claim 8 wherein the minimum flow area of the fuel supply pipe is less than the combined flow area of all of said at least one hole in the fuel supply pipe.

11. The float bowl carburetor of claim 10 wherein the fuel supply pipe includes a main jet and wherein the minimum flow area of the fuel supply pipe is defined by the main jet.

12. The float bowl carburetor of claim 11 wherein the flow area of the outlet is smaller than the minimum flow area of the fuel supply pipe.

13. The float bowl carburetor of claim 9 wherein the fuel supply pipe includes a main jet and wherein the minimum flow area of the fuel supply pipe is defined by the main jet.

14. The float bowl carburetor of claim 13 wherein the flow area of the outlet is smaller than the minimum flow area of the fuel supply pipe.

15. The float bowl carburetor of claim 14 wherein the flow area of the outlet is smaller than the combined flow area of all of said at least one hole in said fuel supply pipe.

16. A float bowl carburetor, comprising:

a body with a fuel and air mixing passage formed therethrough, and a fuel bowl defining at least a portion of a fuel chamber in which a supply of fuel is maintained;

a fuel supply pipe carried by the body in communication with the fuel and air mixing passage and through which fuel is supplied from the fuel chamber to the fuel and air mixing passage;

a fuel passage formed at least in part in the body and having an outlet generally coaxially aligned with the fuel supply pipe;

a priming system including a priming pump communicated with the fuel supply pipe and the fuel chamber through said fuel passage and operable to discharge fluid through said outlet and into said fuel supply pipe upon actuation of the priming pump;

a bolt carried by the fuel bowl and having a passage formed therein with said passage defining a portion of the fuel passage; and wherein the body includes a column that extends into the fuel bowl, has a bore in which the fuel supply pipe is received, and a counterbore in which a main jet is received with a passage through the main jet aligned with the fuel supply pipe, and the bolt is received in said counterbore to facilitate coaxially aligning the outlet with the fuel supply pipe.

17. The float bowl carburetor of claim 16 wherein said counterbore has at least a portion that is threaded and said bolt is threadedly engaged with the column.

18. A float bowl carburetor, comprising:

a body with a fuel and air mixing passage formed therethrough, and a fuel bowl having at least one wall and defining at least a portion of a fuel chamber in which a supply of fuel is maintained;

a fuel supply pipe carried by the body in communication with the fuel and air mixing passage and through which fuel is supplied from the fuel chamber to the fuel and air mixing passage;

a fuel passage defined at least in part by a passage formed in said wall of the fuel bowl and having an outlet generally coaxially aligned with the fuel supply pipe; and a priming system including a priming pump communicated with the fuel supply pipe and the fuel chamber through said fuel passage and operable to discharge fluid through said outlet and into said fuel supply pipe upon actuation of the priming pump.

19. The carburetor of claim 18 wherein the fuel bowl has a bore through a wall of the fuel bowl and the portion of the fuel passage that is formed in the wall of the fuel bowl extends to the bore.

20. A float bowl carburetor, comprising:

a body with a fuel and air mixing passage formed therethrough, and a fuel bowl defining at least a portion of a fuel chamber in which a supply of fuel is maintained;

a fuel supply pipe carried by the body in communication with the fuel and air mixing passage and through which fuel is supplied from the fuel chamber to the fuel and air mixing passage, said fuel supply pipe includes a main jet with a passage that defines the minimum flow area through the fuel supply pipe and wherein the outlet is disposed upstream of the passage of the main jet and the flow area of the outlet is larger than the minimum flow area through the fuel supply pipe;

a fuel passage defined at least in part by a passage defined by the body and having an outlet aligned with the fuel supply pipe;

a priming system including a priming pump communicated with the fuel supply pipe and the fuel chamber through said fuel passage and operable to discharge fluid through said outlet and into said fuel supply pipe upon actuation of the priming pump; and a bolt carried by the fuel bowl and having a passage formed therein with said passage defining a portion of the fuel passage and wherein the passage in the bolt communicates at one end with the portion of the fuel passage formed in the body and the other end of the passage defines the outlet of the fuel passage.

* * * * *